US009346082B2

(12) United States Patent
Thomas

(10) Patent No.: US 9,346,082 B2
(45) Date of Patent: May 24, 2016

(54) GRAVITY SEPARATOR

(71) Applicant: Oliver Manufacturing Company, Inc., Rocky Ford, CO (US)

(72) Inventor: James A. Thomas, Rocky Ford, CO (US)

(73) Assignee: Oliver Manufacturing Company, Inc., La Junta, CO (US)

( * ) Notice: Subject to any disclaimer, the term of this patent is extended or adjusted under 35 U.S.C. 154(b) by 0 days.

(21) Appl. No.: 14/450,842

(22) Filed: Aug. 4, 2014

(65) Prior Publication Data

US 2014/0339140 A1 Nov. 20, 2014

Related U.S. Application Data

(62) Division of application No. 13/207,470, filed on Aug. 11, 2011, now Pat. No. 8,827,081.

(51) Int. Cl.

| | |
|---|---|
| ***B07B 13/00*** | (2006.01) |
| ***B07B 13/11*** | (2006.01) |
| ***B03B 4/02*** | (2006.01) |

(52) U.S. Cl.
CPC ..... *B07B 13/113* (2013.01); *B03B 4/02* (2013.01)

(58) Field of Classification Search
USPC ..... 209/725, 728, 729, 210
See application file for complete search history.

(56) References Cited

U.S. PATENT DOCUMENTS

| | | | | |
|---|---|---|---|---|
| 1,949,729 | A * | 3/1934 | Peale | B03B 4/00 209/467 |
| 2,069,331 | A * | 2/1937 | Munro | B07B 1/34 209/326 |
| 2,088,816 | A * | 8/1937 | Shaw | B03B 4/00 209/44 |
| 2,269,307 | A | 1/1942 | Dickerson | |
| 2,404,414 | A | 7/1946 | Sutton | |
| 2,759,605 | A | 8/1956 | Steele | |
| 2,937,750 | A | 5/1960 | Wohlrabe et al. | |
| 3,108,950 | A * | 10/1963 | Buckley | B03B 4/02 209/20 |
| 3,667,601 | A * | 6/1972 | Johnston | B03B 4/065 209/466 |
| 3,777,887 | A * | 12/1973 | Johnston | B03B 4/065 209/474 |
| 4,521,302 | A | 6/1985 | Stone | |
| 4,793,918 | A | 12/1988 | Thomas | |
| 5,087,351 | A | 2/1992 | Valentine, Sr. | |
| 6,079,568 | A * | 6/2000 | Loshe | B01D 33/0353 209/311 |
| 6,343,234 | B1 | 1/2002 | Thomas | |
| 6,371,301 | B1 | 4/2002 | Schulte et al. | |
| 7,708,145 | B2 | 5/2010 | Li et al. | |
| 2011/0060469 | A1 | 3/2011 | Burkhard | |

OTHER PUBLICATIONS

Final Office Action issued in U.S. Appl. No. 13/207,470 mailed Jul. 25, 2013.

* cited by examiner

*Primary Examiner* — Terrell Matthews
(74) *Attorney, Agent, or Firm* — Banner & Witcoff, Ltd.

(57) ABSTRACT

An apparatus, method, and system are provided for separating material. In some embodiments the separator may include a deck. The deck may accept the material to be separated at a feed end and may provide separated output material at a discharge end. The flow of the material along the deck from the feed end to the discharge end may define a feed direction. The deck may be subject to a vibration or conveyance aligned with the feed direction. The deck may include riffles or corrugations. The riffles may be oriented at an angle relative to a direction of the vibration or conveyance, or at an angle relative to the feed direction. The deck may be subjected to an end-to-end elevation or slope. The end-to-end slope may be positive/downhill, negative/uphill, or zero.

7 Claims, 10 Drawing Sheets

GRAVITY SEPARATOR

RELATED APPLICATION INFORMATION

This application is a divisional of and claims priority to U.S. Ser. No. 13/207,470, filed Aug. 11, 2011, entitled, "Gravity Separator," whose contents are expressly incorporated herein by reference.

BACKGROUND

Separators have been used to separate out and filter material in various application environments. For example, separators may be used to separate out recyclable materials from non-recyclable materials, to separate minerals from rocks, and to filter or otherwise separate out seed used in agriculture. Such separations are based on density (e.g., a relationship based on weight and particle aerodynamics).

Users frequently want to increase the capacity or load that a separator can process over a given time period. Using conventional separators, increasing the material load per unit time would result in a degradation of separation in terms of the quality (e.g., the concentrations) of the output produced by the separator.

Improvements are needed in terms of the design and operation of separators.

SUMMARY

This summary is not intended to identify critical or essential features of the disclosure provided herein, but instead merely summarizes certain features and variations thereof.

In some illustrative embodiments, a separator may include a feeder and a deck. In some illustrative embodiments, the deck may be used (possibly in connection with other components and/or devices) to subject feed material to vibration and conveying action, amongst other inputs. The feeder may be used to regulate flow to the deck. The feeder may supply feed at a uniform rate and a controlled volume or capacity. The deck may support the product being separated. The deck may include a porous surface. The pores may be small enough that none of the incoming feed falls through. Pore size may be made as large as possible to allow air to pass upward through a bed of feed to be processed. The deck may also provide a friction surface. As the deck is vibrated contact between the deck surface and the product being separated may produce motion in the direction of vibration. Material to be separated may be supplied or input to the feeder. The feeder may, in turn, supply or feed the material at a controlled rate to the deck. The deck may be configured to vibrate. In some embodiments, the direction of the vibration of the deck or a conveyance direction may be aligned with (e.g., may be parallel to, or substantially parallel to) the feed direction of the material.

In some embodiments, the deck of a separator may include riffles. The riffles may be oriented at an angle relative to a conveyance or vibration direction associated with the separator. In some embodiments, the riffles may be oriented at an angle relative to a flow or feed direction of material on the deck.

In some embodiments, a separator may be configured to elevate one end of a deck relative to the other. For example, a deck may be elevated at a feed end relative to a discharge end, which may result in a positive (or downhill) elevation or slope. In some embodiments, the deck may be elevated at the discharge end relative to the feed end, which may result in a negative (or uphill) elevation or slope. In some embodiments, the feed end and the discharge end may be at the same elevation relative to one another (e.g., a state of zero elevation or slope end-to-end).

In some embodiments, tilt may be obtained by elevating or raising a first side of a deck relative to a second side of the deck. Tilt may be used to supply or create a force to drive (lighter) material towards one side of the deck in order to obtain a separation or concentration of material on the deck.

In some embodiments, air may be applied to material on the deck. The air may be used to provide an "air weighing" of the material being separated on the deck. For example, application of the air may cause lighter material to move towards the top of a bed of material on the deck, allowing the heavier or denser material to sink to the bottom of the bed of material on the deck or towards the surface of the deck. Over time, a stratification or separation of material may be obtained on the deck, with heavier or denser materials residing at the bottom close to the surface of the deck and lighter materials residing at the top of the bed (e.g., vertically above the heavier/denser material).

Other details and features will also be described in the sections that follow.

BRIEF DESCRIPTION OF THE DRAWINGS

The present disclosure is pointed out with particularity in the appended claims. Features of the disclosure will become more apparent upon a review of this disclosure in its entirety, including the drawing figures provided herewith.

Some features herein are illustrated by way of example, and not by way of limitation, in the figures of the accompanying drawings and in which like reference numerals refer to similar elements.

DETAILED DESCRIPTION

Various connections between elements are discussed in the following description. These connections are general and, unless specified otherwise, may be direct or indirect, and this specification is not intended to be limiting in this respect.

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made, without departing from the scope of the present disclosure.

The details of a conventional separator are known to one of ordinary skill in the art. As such, and for the sake of brevity, the basic principles, devices, and components of a conventional separator have been omitted from this disclosure. The reader is referred to U.S. Pat. Nos. 6,343,234; 4,793,918; and 2,759,605 (the contents of these patents/documents are incorporated herein by reference) for possible implementation details regarding a conventional separator. Of course, the design(s) provided therein are illustrative, and it is understood that one or more aspects of this disclosure could be applied to separators different from those described in the aforementioned U.S. patents.

Figure 1:
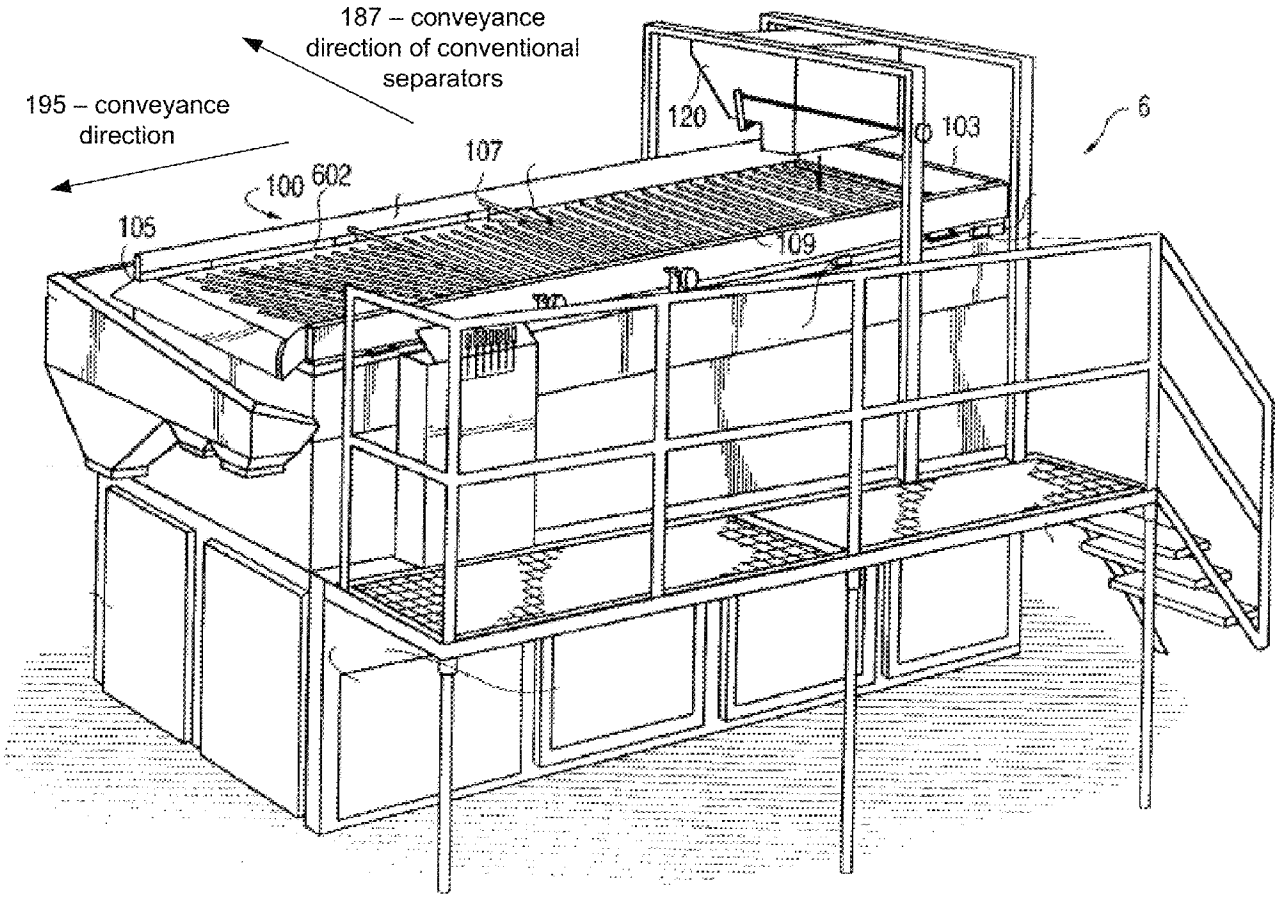
FIG. 1 illustrates an example separator in accordance with one or more aspects of this disclosure.

FIG. 1 illustrates a separator 6 that may be used in accordance with one or more aspects of this disclosure. Separator 6 shown in FIG. 1 is similar to separator 6 shown in FIG. 2a of U.S. Pat. No. 6,343,234, with many of the informational details (e.g., reference numbers) associated with FIG. 2a of U.S. Pat. No. 6,343,234 having been removed in FIG. 1 so as to simplify the illustration and to facilitate this description.

Referring to FIG. 1, in some embodiments material may be supplied to feeder 120. Feeder 120 may, in turn, provide the material to be separated to deck 100. The material may flow (e.g., have a feed direction) from a feed end 103 to a discharge end 105.

In conventional separator designs, a deck of the separator may be made to vibrate in a direction that is perpendicular (or substantially perpendicular) to the flow of the material being separated. Thus, in reference to FIG. 1, in conventional separator designs deck 100 would be made to vibrate in a direction from side 109 to side 107 (thereby defining a conveyance direction as reflected via arrow 187). In conventional separators, the vibration would cause heavier materials to move in the direction of the conveying action (e.g., in the direction of arrow 187) and lighter materials to move in a direction opposite the conveying direction (e.g., in a direction opposite arrow 187).

In pre-existing designs, vibration may act to convey heavy material uphill in the direction of vibration. The lighter material may flow over the top of the heavier material downhill against the action of the vibration. The flow rate of the product or material from a feed end to a discharge end may be entirely related to the downhill (positive) slope from the feed end to the discharge end. According to one or more aspects of this disclosure, the vibration may act as a conveyor to move product or material from the feed end to the discharge end. Angled riffles may move the heavier product or material as it is conveyed. A tilt of the deck may allow lighter product or material to flow over the surface of the heavier product or material and be concentrated along the low side. Positive, zero and negative slope may be used to regulate the flow of product from feed end to discharge end.

In some embodiments incorporating one or more aspects of this disclosure, a separator may be configured to vibrate a deck in a direction that is aligned with (e.g., is parallel to, or substantially parallel to) the flow of the material being separated. In reference to FIG. 1, in some embodiments deck 100 may be configured to vibrate in a direction from feed end 103 to discharge end 105 (thereby defining a conveyance direction as reflected via arrow 195). In some embodiments incorporating aspects of this disclosure, the conveyance or vibration direction may be oriented from discharge end 105 to feed end 103 (e.g., opposite the direction indicated by arrow 195).

In some embodiments, during each vibration cycle, material may be thrown up and forward during the push portion of the cycle (e.g., in the direction of arrow 195). During the return or retract portion of the cycle, the material may be in free fall relative to the push portion of the cycle but still moving, e.g., forward. After the retract portion of the cycle is completed, the push portion of the cycle may begin again, and the cycle or process may continue in a repetitive fashion.

In some embodiments, a suspension system may be used to supply vibration to the deck. The vibration speed or rate may be controlled by changing the speed of a drive. Faster rates of vibration may produce a faster conveying agitation and may result in the material being exposed to separating action for less time. Conversely, slower rates of vibration may produce a slower conveying agitation and may result in the material being exposed to separating action for a longer time. The suspension system may provide for tilt and slope as described further below.

Vibration may serve one or more purposes. For example, vibration may provide agitation and conveying action. The vibration rate may be sufficient to provide agitation but not so fast that it creates turbulence. A conveyance rate may be a function of vibration speed. Conveyance rate may be controlled using positive, zero or negative slope.

In some embodiments, the length of the vibration stroke or cycle can be varied. For example, for a given rate of vibration a longer vibration stroke may produce more agitation and a faster conveyance rate. Conversely, a shorter vibration stroke may produce less agitation and a slower conveyance rate.

In some embodiments, a vibrator may be set up as a rotary device using a cam and push rod assembly, as an electronic vibrator using magnetic pulses to create vibrating action, or as an inertial vibrator using rotating weights to produce a (linear) thrust.

Figure 2:
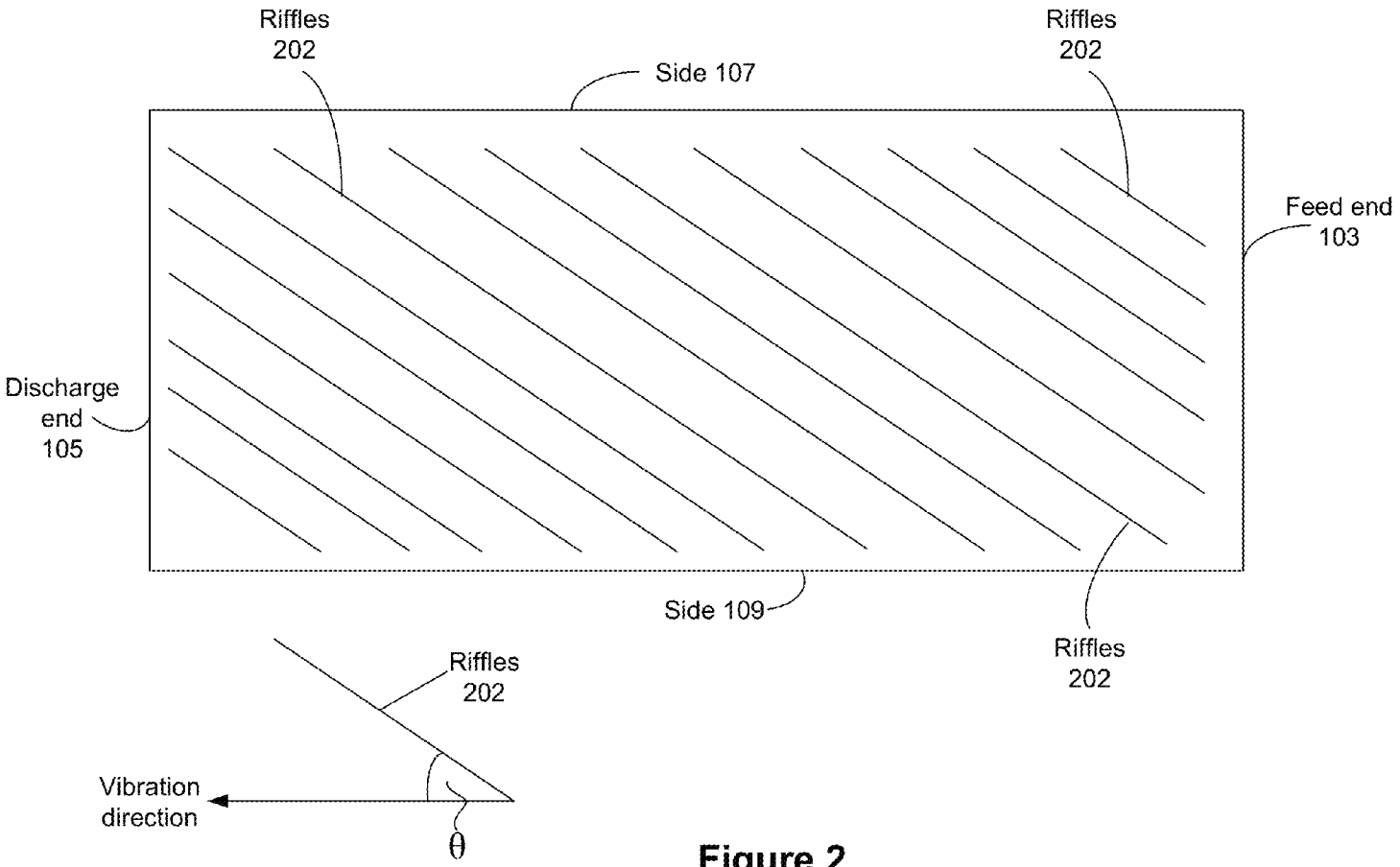
FIG. 2 illustrates a deck in accordance with one or more aspects of this disclosure.

FIG. 2 illustrates a "bird's eye" or overhead view of deck 100 of FIG. 1. In some embodiments, deck 100 may include riffles or corrugations 202. In some embodiments, riffles 202 may be aligned with the conveyance or vibration direction of deck 100, but placed at an angle relative to the conveyance direction. For example, as shown in FIG. 2, in some embodiments riffles 202 may be aligned at an angle theta (θ) of approximately 5 degrees to 30 degrees relative to the vibration direction of deck 100. Any angle of orientation (from 0 degrees to 360 degrees) of riffles 202 relative to the vibration direction may be used. Some embodiments may exclude particular angles (or angles in close proximity to particular angles) of orientation for riffles 202 from being used, such as 0 degrees, 90 degrees, 180 degrees, 270 degrees, or 360 degrees, for example. Moreover, while shown as using a common angle θ in FIG. 2, in some embodiments a first riffle or set of riffles 202 may be oriented at a first angle (e.g., θ1) that is different from a second angle (e.g., θ2) used for a second riffle or set of riffles 202.

Riffles 202 may be used to produce a force that moves the (heavier) material located at or towards the bottom of the bed of product (e.g., material in contact with or in close proximity to the surface of deck 100) being separated uphill (e.g., towards side 107) during the push portion of the vibration cycle. The height, spacing, and angle of riffles 202 may be varied for material of different sizes, weights, or flowability. The height of riffles 202 may be selected so that heavier material will be trapped by riffles 202. When riffles 202 are oriented at an angle with respect to the conveyance direction, the heavier material may move in a direction dictated by the angle. Lighter material may move to the top of the deck (e.g., above the height of riffles 202) and flow downhill over the top of the riffles 202.

In some embodiments, deck 100 may be subject to tilt. For example, in some embodiments side 107 may be elevated or raised relative to side 109 and may be used to supply or create a force to drive (lighter) material towards side 109 (e.g., opposite to the uphill motion created by riffles 202 shown in FIG. 2). In some embodiments, side 109 may be elevated or raised relative to side 107. In some embodiments, sides 107 and 109 may be at the same relative elevation (e.g., a state of zero tilt). In some embodiments, relative to a state of zero tilt, deck 100 may be tilted plus or minus ninety degrees, with ranges of plus or minus twenty degrees being more typical. In some embodiments, tilt may be obtained using hydraulics or a gear motor screw drive. In some embodiments, tilt may be obtained by manual mechanisms. For example, the manual mechanisms used to provide tilt may include screw devices turned by hand cranks, levers with mechanical linkage to change tilt and slope, slide gates operated by pushing or pulling by hand, etc. The manual mechanisms may include any adjustment that can be accomplished by hand without additional assistance from electronics, motors, pumps or other externally powered devices. Some embodiments may use electronics, motors, pumps, and/or externally power devices, possibly in combination with manual mechanisms. The controls and mechanisms used to create the tilt (or any other adjustment, such as feed, slope, vibration, air, discharge, etc.) may be durable enough to withstand vibration yet sensitive enough to provide for fine adjustments.

In some embodiments, one end of deck 100 may be elevated relative to the other. For example, in some embodiments feed end 103 may be elevated relative to discharge end 105, which may result in a positive (or downhill) elevation or slope. All other things being equal, positive or downhill slope may increase the flow rate of material through separator 6 or across deck 100 and may be used when material separates out relatively easily or quickly. Increasing the flow rate may subject the material to fewer vibration cycles.

In some embodiments, discharge end 105 may be elevated relative to feed end 103, which may result in a negative (or uphill) elevation or slope. All other things being equal, negative or uphill slope may tend to decrease the flow rate of material through separator 6 or across deck 100 and may be used when it is difficult to separate out the material or the material separates slowly. Decreasing the flow rate may subject the material to additional vibration cycles. Negative or uphill slope may tend to decrease capacity. In order to avoid a decrease in capacity in connection with using a negative or uphill slope, one or more actions may be taken, such as increasing the rate of vibration. Increasing the rate of vibration may provide more agitation to the material being separated and provide a greater conveying action to overcome resistance created by the uphill slope/climb.

In some embodiments, feed end 103 and discharge end 105 may be at the same elevation relative to one another (e.g., a state of zero elevation or slope end-to-end). In some embodiments, relative to a state of zero slope end-to-end, a deck may be elevated in a range of plus or minus ninety degrees.

In some embodiments, the linkage used to create the end-to-end elevation or slope may be manual (such as the manual mechanisms described above in connection with tilt), hydraulic, air operated, or a gear motor screw drive. The controls and mechanisms used to create the slope may be durable enough to withstand vibration yet sensitive enough to provide for fine adjustments.

The angle of riffles 202 relative to the feed direction, the relative tilt of deck 100 with respect to sides 107 and 109, the relative elevation or slope of deck 100 with respect to ends 103 and 105, the speed or frequency with which deck 100 may be made to vibrate, and the qualities of air flow (described further below) that deck 100 may be subjected to, may be adjusted, modified, or balanced in some embodiments to achieve desired results. The choice of which configuration to apply to a separator may be a function of the material that is being separated.

Figure 3A:
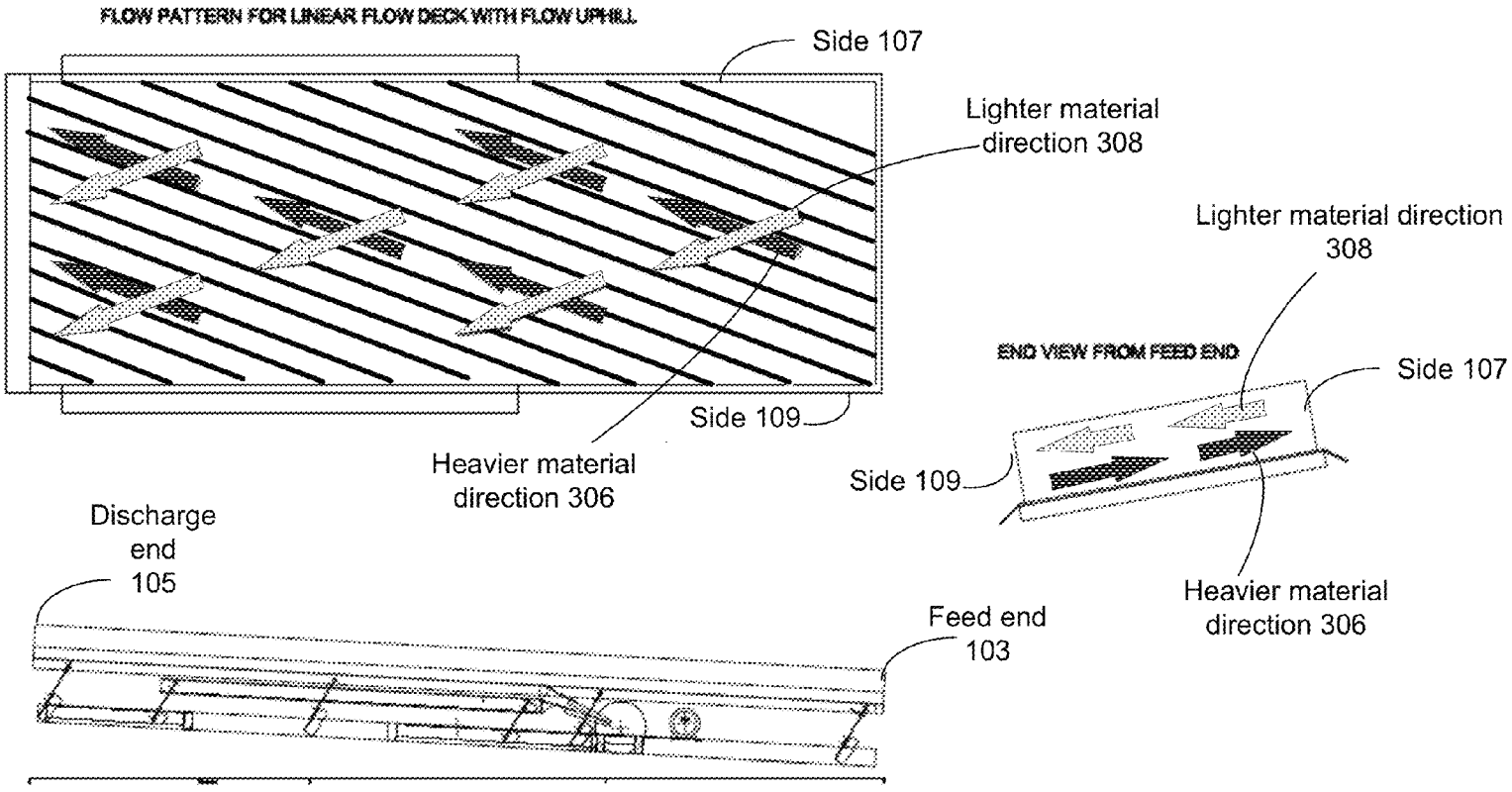
FIGS. 3A-3C illustrate flow patterns in accordance with one or more aspects of this disclosure.
Figure 3B:
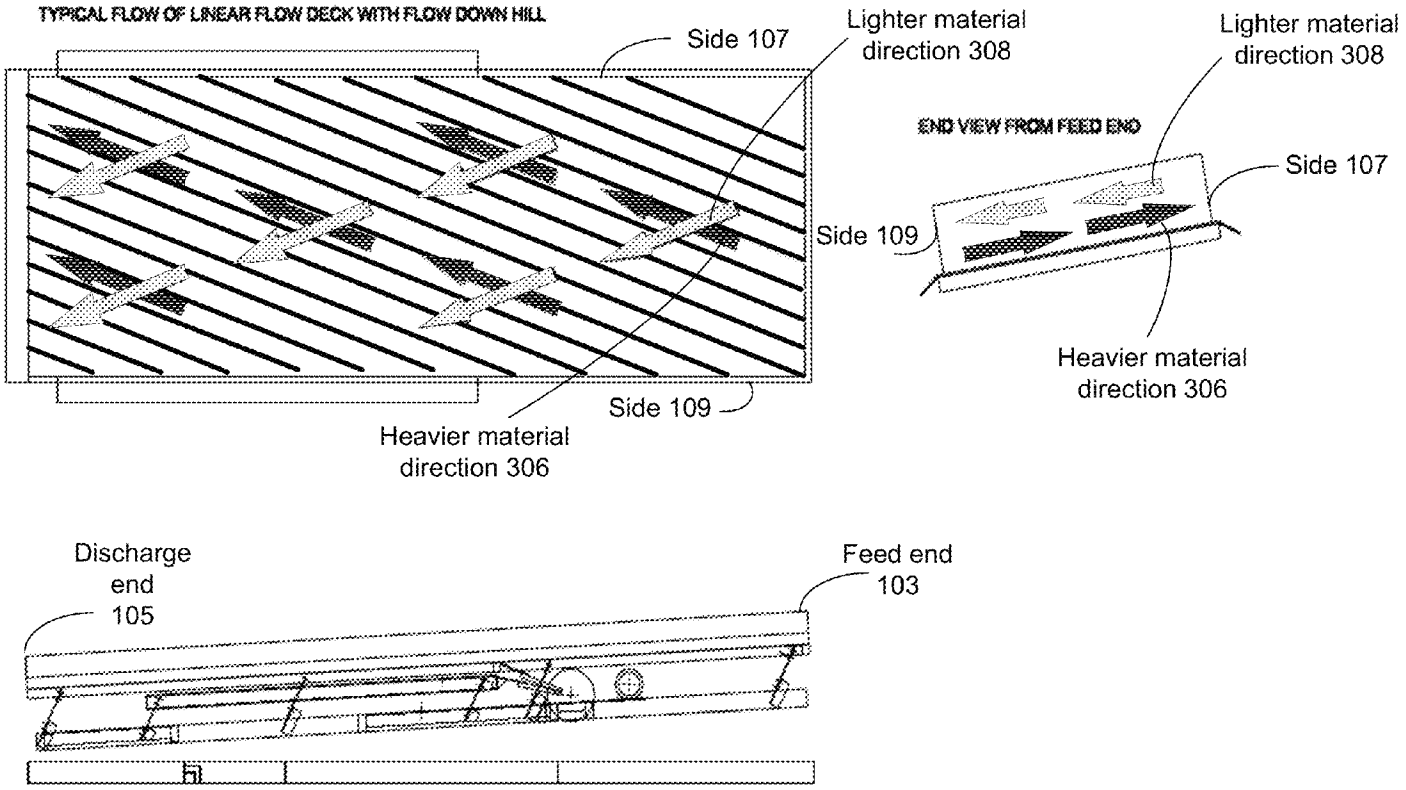
Figure 3C:
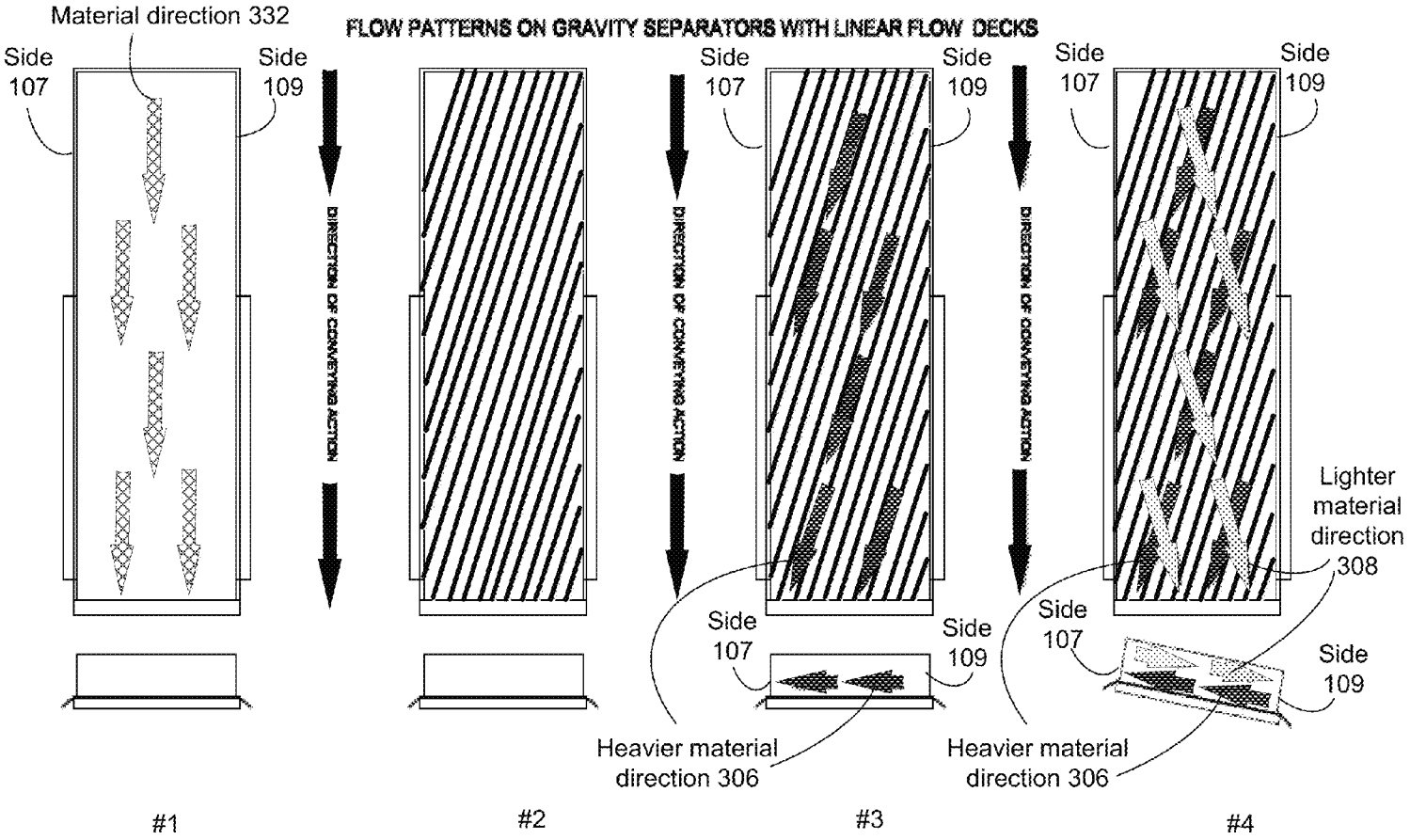

FIGS. 3A-3C illustrate various flow patterns in accordance with one or more aspects of this disclosure.

FIG. 3A shows a flow pattern for material on a deck subjected to a negative (or uphill) elevation or slope and tilt where side 107 is raised relative to side 109. In FIG. 3A, denser product or material may settle between the riffles and may be conveyed upward toward side 107 (as reflected via the heavy or filled-in arrows 306 in FIG. 3A). Lighter or less dense product or material may float over the top of the denser product/material and may be conveyed downward toward side 109 (as reflected via the lighter or empty arrows 308 in FIG. 3A). In the embodiment shown in FIG. 3A, the riffles may be set on a twenty degree angle, the deck may be tilted by ten degrees, and the slope may be (negative) three degrees. Relative to a deck of zero elevation or slope, the deck shown in FIG. 3A may result in improved separation quality. In some embodiments a higher vibration speed or rate may be used to maintain capacity on the deck shown in FIG. 3A relative to a deck subject to zero or no elevation or slope. Higher vibration may enhance fluidity for improved separation.

FIG. 3B shows a flow pattern for material on a deck subjected to a positive (or downhill) elevation or slope and tilt where side 107 is raised relative to side 109. In FIG. 3B, denser product or material is conveyed upward toward side 107 and lighter or less dense product or material is conveyed downward toward side 109. In the embodiment shown in FIG. 3B, the riffles may be set on a twenty degree angle, the deck may be tilted by ten degrees, and the slope may be (positive) three degrees. Relative to a deck of zero elevation or slope, the deck shown in FIG. 3B may result in a reduction in terms of separation quality. In some embodiments a lower vibration speed or rate may be used to maintain capacity on the deck shown in FIG. 3B relative to a deck subject to zero or no elevation or slope.

FIG. 3C illustrates four "top view" flow patterns (labeled 1-4) for material on a deck in various configurations.

In flow pattern #1 of FIG. 3C, the deck does not include any riffles, the deck is not subject to tilt, and the deck is not subject to end-to-end slope. In flow pattern #1 of FIG. 3C, there is not any particular tendency for denser product or material to move to a first side of the deck (e.g., side 107) relative to the other side of the deck (e.g., side 109). All the material is shown in flow pattern #1 of FIG. 3C as flowing in a common direction as reflected via the cross-hatched arrows 332.

In flow pattern #2 of FIG. 3C, the deck includes riffles (e.g., riffles 202 of FIG. 2). The riffles shown in flow pattern #2 of FIG. 3C are at an angle of twenty degrees and are spaced four inches apart. Other values for the angle or spacing may be used based on the product or material being separated. In flow pattern #2 of FIG. 3C, the deck is not subject to tilt and the deck is not subject to end-to-end slope.

Flow pattern #3 of FIG. 3C represents the flow of denser product or material in connection with the inclusion of riffles in flow pattern #2. As shown in flow pattern #3, dense product or material may settle between the riffles and follow the channels created by the riffles upwards in the direction of side 107. Thus, relative to the flow shown in flow pattern #1 of FIG. 3C, the introduction of riffles in flow patterns #2 and #3 of FIG. 3C may result in an enhanced concentration of product or material exhibiting a particular characteristic (e.g., density).

In flow pattern #4 of FIG. 3C, the deck includes riffles, and the deck is subject to tilt but not end-to-end slope. As shown in flow pattern #4 of FIG. 3C, dense product or material may settle between the riffles and follow the channels created by the riffles upwards in the direction of side 107. Lighter or less dense product or material may move downward in the direction of side 109. Thus, relative to the flow patterns #2 and #3 of FIG. 3C, the introduction of tilt in flow pattern #4 of FIG. 3C may further enhance the concentration of product or material exhibiting a particular characteristic (e.g., density) at various points on the deck (e.g., at or in proximity to side 107). In flow pattern #4 of FIG. 3C, air has also been supplied from underneath the deck. The supplied air may fluidize and stratify the bed. Because the product is stratified, lighter material may flow over the top of the heavier material which is conveyed uphill by the combined action of the vibration and the riffles.

FIGS. 4A-4D illustrate various flow patterns and deck shapes.

Figure 4A:
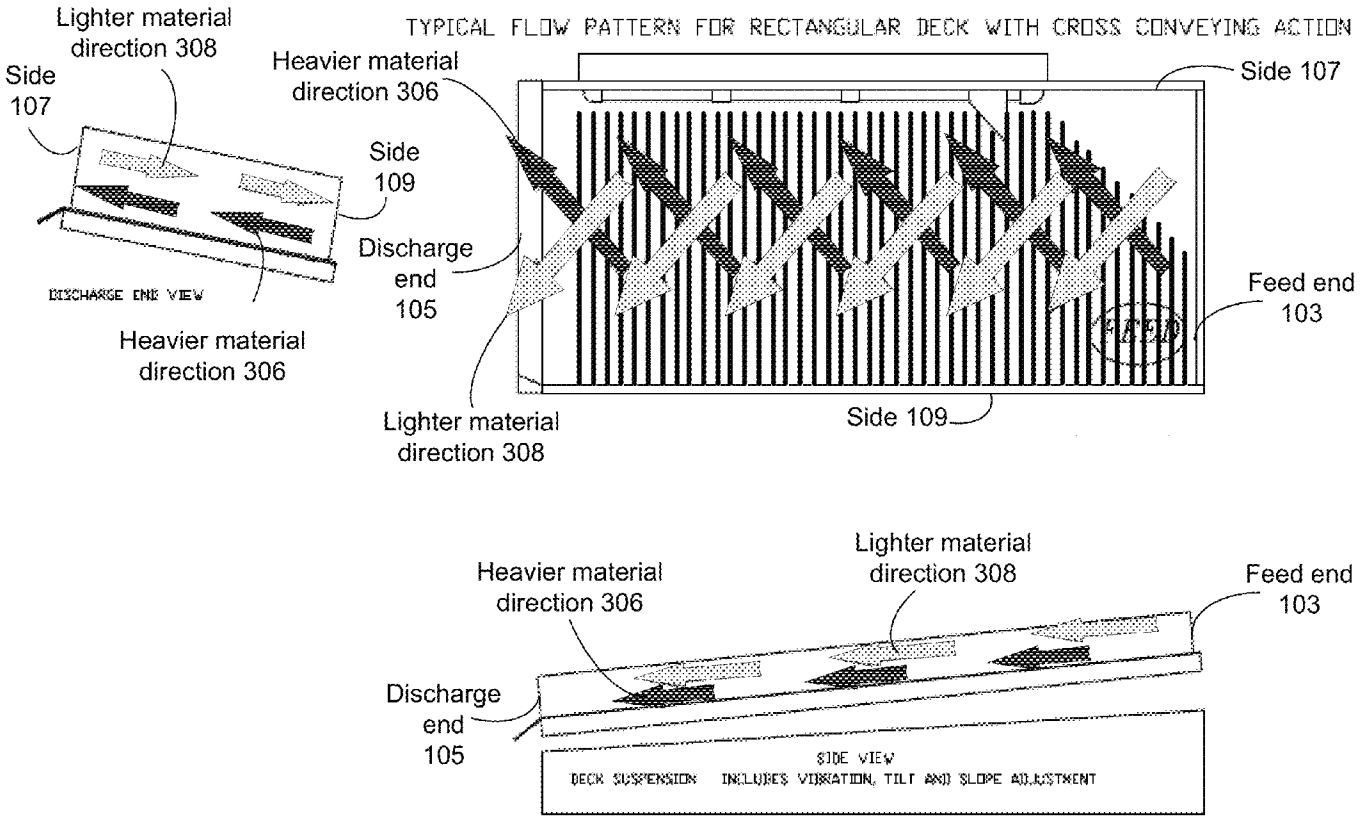
FIGS. 4A-4D illustrate flow patterns and deck shapes in accordance with one or more aspects of this disclosure.

FIG. 4A illustrates a rectangular deck shape, where the applied conveying action is in a direction (aligned or substantially aligned from side 109 toward side 107) that is perpendicular or substantially perpendicular to the flow direction of the material on the deck from feed end 103 to discharge end 105, and where the riffles are aligned parallel to or substantially parallel to the direction of the conveying action. The deck in FIG. 4A is subject to downhill (positive) end-to-end slope and tilt where side 107 is elevated relative to side 109. The tilt may be ten degrees. In operation, dense material may settle in the channels created by the riffles and may move upwards in the direction of side 107. Similarly, lighter or less dense material may move downward in the direction of side 109. Relative to a deck of zero elevation or slope, the deck shown in FIG. 4A may result in a reduction of separation quality. In some embodiments a lower vibration speed or rate may be used to maintain capacity on the deck shown in FIG. 4A relative to a deck subject to zero or no elevation or slope.

Figure 4B:
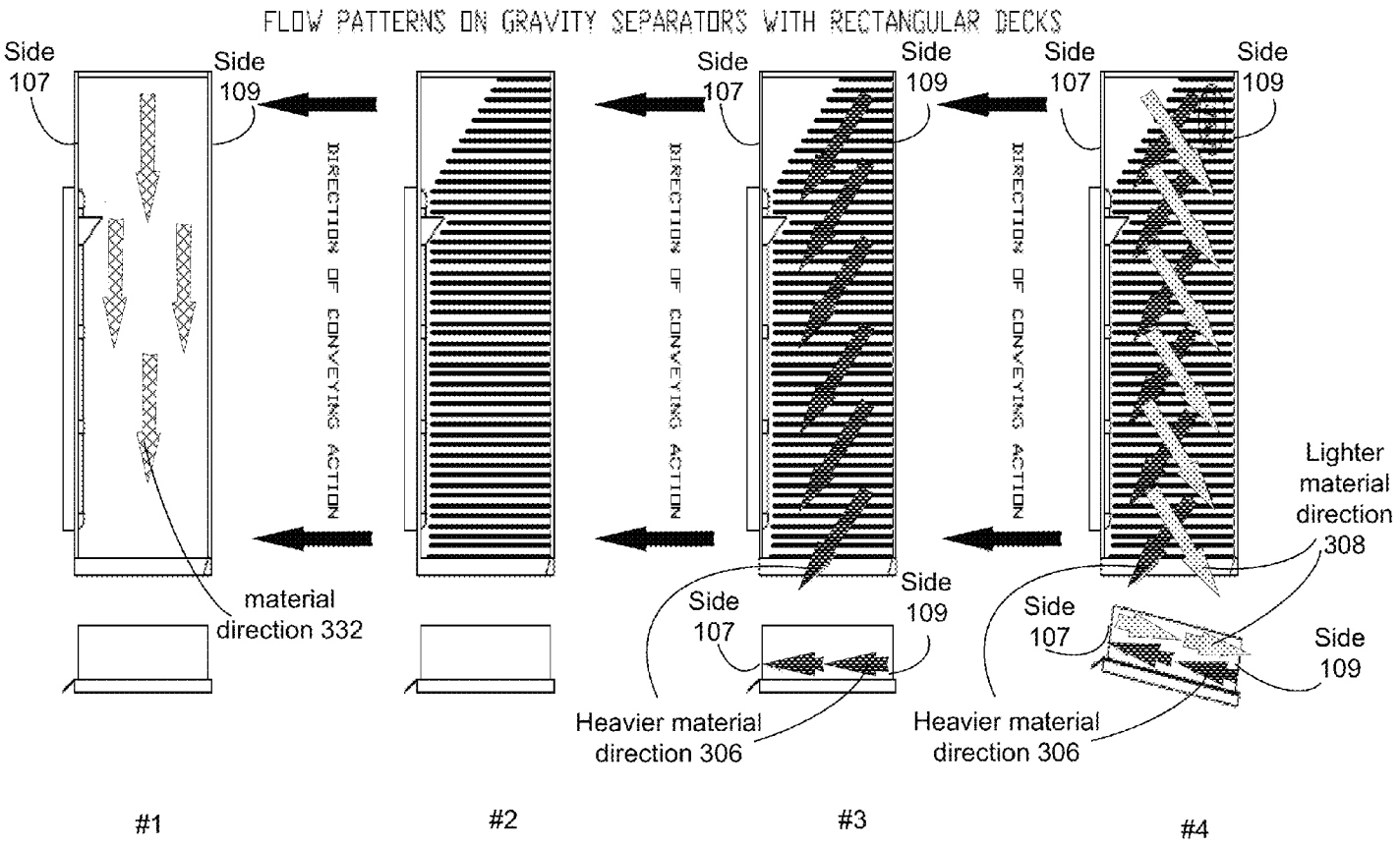

FIG. 4B illustrates four "top view" flow patterns (labeled 1-4) for material on a (rectangular) deck in various configurations. The flow patterns #1-4 in FIG. 4B are similar to their counterpart flow patterns #1-4 illustrated in FIG. 3C, and as such, a complete repetition of the description above is omitted for the sake of brevity. The primary differences between the flow patterns in FIG. 3C and the flow patterns in FIG. 4B are the orientation of the riffles and the direction of the conveying action as shown.

Figure 4C:
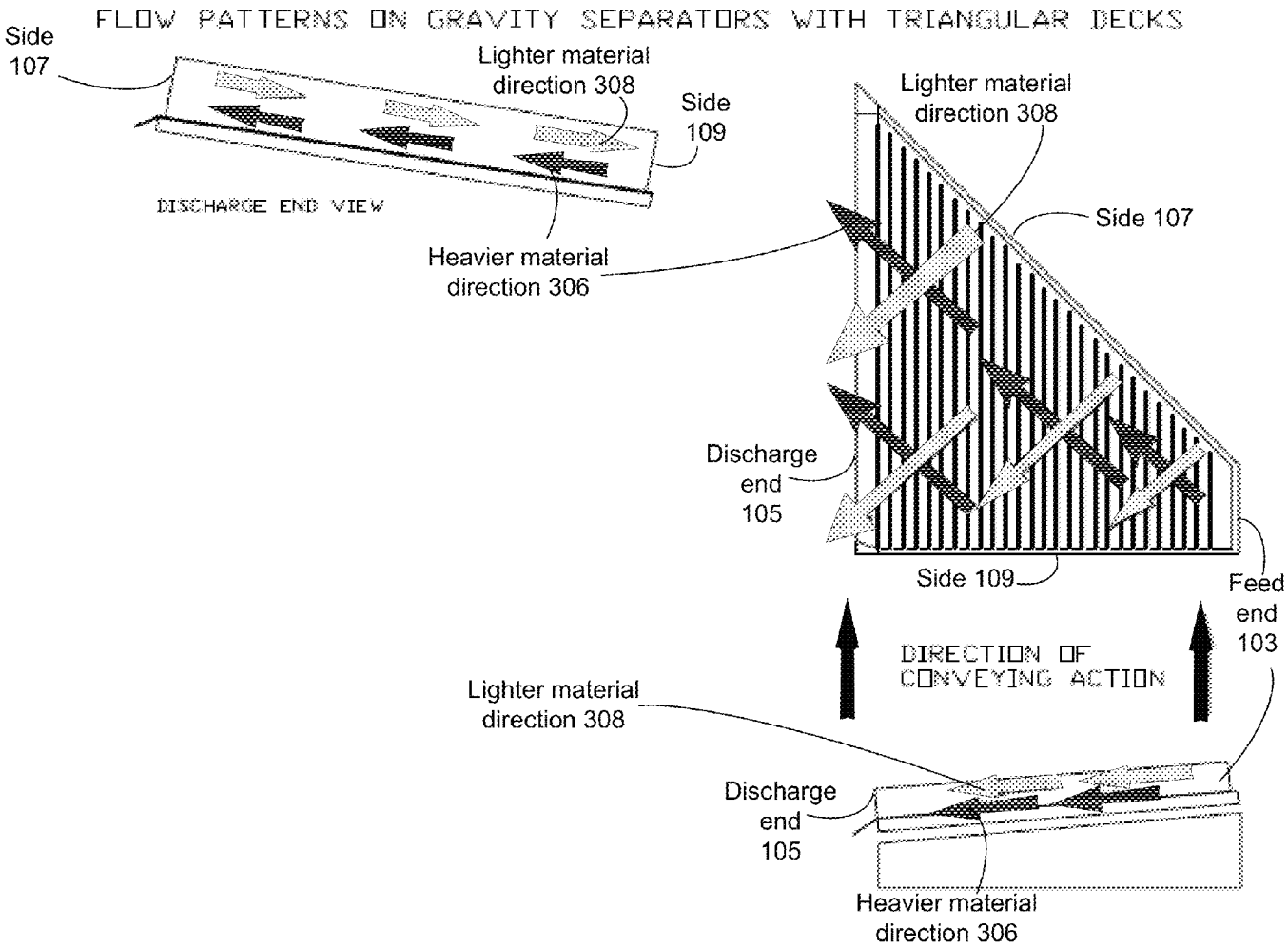

FIG. 4C illustrates a flow pattern for a triangular shaped deck. The flow illustrated in connection with FIG. 4C is similar to the flow shown in FIG. 4A. The deck of FIG. 4C may be tilted by ten degrees and subject to a positive slope, and the riffles may be aligned with or parallel to the conveying action. Relative to a deck of zero elevation or slope, the deck shown in FIG. 4C may result in a reduction in terms of separation quality. In some embodiments a lower vibration speed or rate may be used to maintain capacity on the deck shown in FIG. 4C relative to a deck subject to zero or no elevation or slope.

Figure 4D:
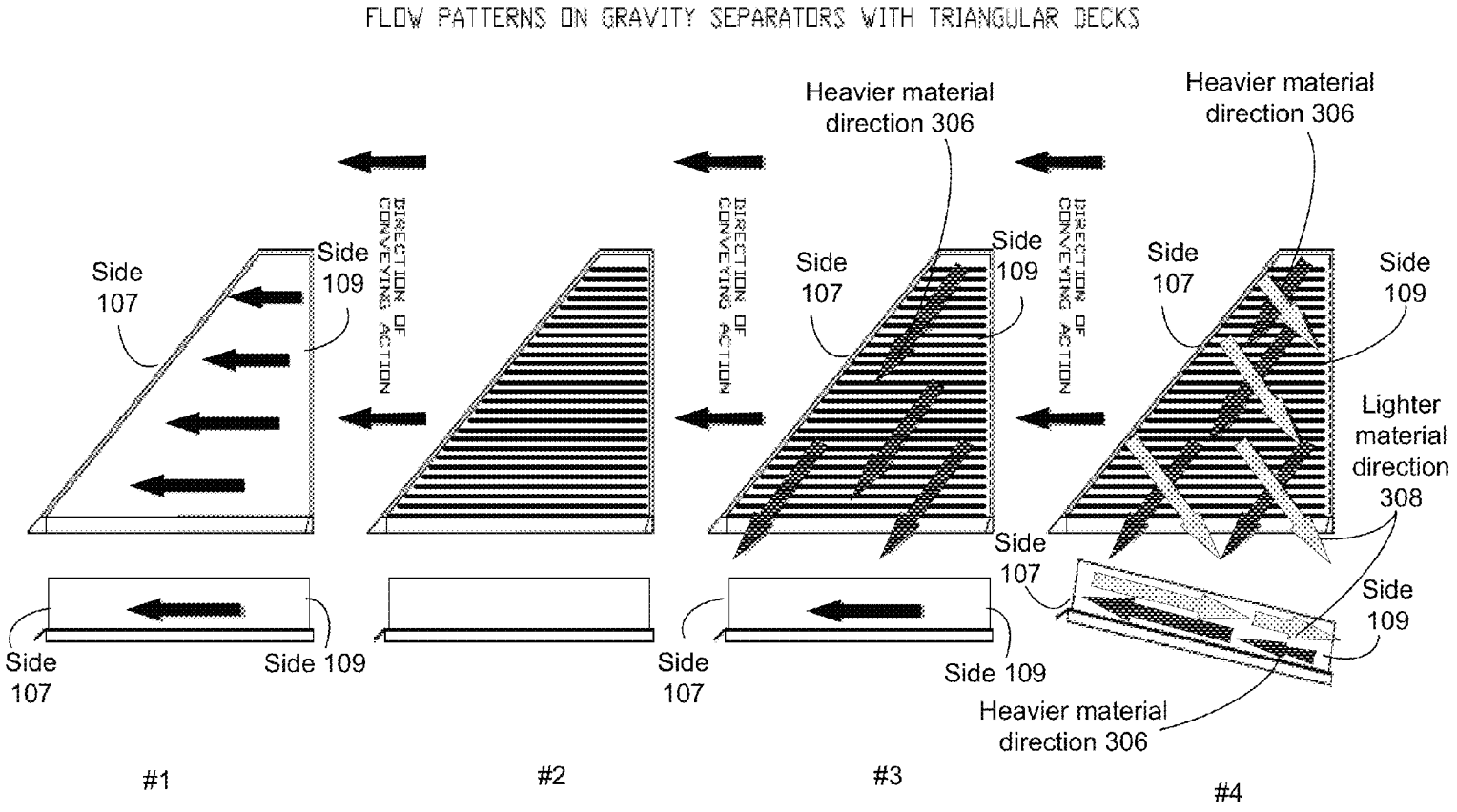

FIG. 4D illustrates four "top view" flow patterns (labeled 1-4) for material on a (triangular) deck in various configurations. The flow patterns #1-4 in FIG. 4D are similar to their counterpart flow patterns #1-4 illustrated in FIG. 4B, and as such, a complete repetition of the description above is omitted for the sake of brevity.

In some embodiments, air may be used as a weighing medium. The velocity of the air may be approximately 10-50% of the velocity required to lift the material in a vertical column. The volume of air that may be used may be a function of the size of the deck (e.g., deck 100) and the velocity of air required to lift and fluidize the material. Larger velocity and larger volumes of air may be used for larger or denser materials. Lesser velocity and lesser volumes of air may be used for smaller material or materials of lower density.

The air may be provided by an air delivery system. The air delivery system may include one or more fans, blowers, or the like. The air delivery system may be included in the separator or may be external to the separator.

In some embodiments, a pressure system may be used in connection with the application of the air. The pressure system may be used to compress the applied air, providing for a higher density of air than ambient air, and resulting in a greater lift at lower velocity than ambient air.

In some embodiments, a vacuum (such as a suction fan) may be used in connection with the application of the air. The vacuum may be controlled from a single source or from multiple sources. Use of a vacuum may result in a reduction in air density. A vacuum may facilitate collection and containment of exhaust air for purposes of dust control, such as for use with a dust hood as described herein.

In some embodiments, both a pressure system and a vacuum may be used to provide process air for separation and suction for control and dust collection. Use of the pressure system and vacuum may tend to increase power consumption, and so, tradeoffs may be made to obtain desired results. For example, a tradeoff between air quality/cleanliness and power consumption may be made.

The air may be provided upward through the deck, which may result in an "air weighing" of the material being separated on the deck. For example, application of the air may cause lighter material to move towards the top of the deck, allowing the heavier or denser material to sink to the bottom or towards the surface of the deck. Over time, a stratification or separation of material may be obtained on the deck, with heavier or denser materials residing at the bottom close to the surface of the deck and lighter materials residing at the top of the bed (e.g., vertically above the heavier/denser material).

In order to facilitate air flow, a deck may be made of a porous surface. The pores may be selected so that the pores are large enough to allow optimum air flow up through the deck, yet small enough that none of the material being processed can pass through and fall down through the deck. The size of the pores may also be selected such that none (or minimal amounts of) the material being separated becomes wedged in the pores (which might restrict the flow of air). In some embodiments, the porous surface may be composed of one or more of woven wire, woven synthetic fabric, woven cloth, and a perforated metal or a plastic sheet. The surface may be embossed with dimples or corrugations to enhance conveying action.

In some embodiments, greater precision or accuracy in terms of material separation may be obtained when subjecting the material to air and vibration for a longer period of time.

In some embodiments, a dust hood or other collection device may be used to collect the air after the material has undergone "air washing." This collection may be used to clean the air of dust, dirt, fine material, or other light "trash" that may be kicked-up as a result of the application of the air and vibration to the material being separated. In some embodiments, the dust hood may be designed such that the flow of process air is contained and controlled with a minimum of resistance to air flow. In some embodiments, after the air has been collected and treated by a recycled air system, the air may be exhausted to an area remote from the separator (e.g., outside of a processing plant). In some embodiments, after the air has been collected and treated, the air may be returned to an area in proximity to the separator (e.g., inside a processing plant) or to the separator itself (e.g., the air delivery system) for purposes of future air application. In some embodiments the dust hood may be integrated or incorporated in the separator, while in other embodiments the dust hood may be separate from the separator. In some embodiments, such as those embodiments where the material produces little to no dust or fine material, a dust hood might not be used or a partial dust hood (covering a portion of the deck) may be used.

As described above, in some embodiments various inputs or controls (such as the angle, height, or construction of riffles associated with a deck, the relative tilt and end-to-end elevation or slope of a deck, the speed or frequency with which a deck may be made to vibrate, and the qualities of air flow) may be adjusted or balanced to achieve desired results with respect to particular material being separated. In some embodiments, a feeder (e.g., feeder 120 of FIG. 1) may include or be associated with a feeding device configured to control a flow rate of material onto the deck. For example, the feeding device may be configured to provide a uniform flow rate of material onto the deck in order to ensure consistency in the output material at the discharge end 105. In some embodiments, the feeding device may include a (positive) shut off and opening device to stop the flow of material onto the deck when the separator is stopped and to (re)start the flow when the separator is (re)started. The feeding device may include one or more of a sliding or swinging door, a rotary feeder, a vibratory feeder, a controlled feeder, etc.

In some embodiments, a discharging system may be included in, or associated with, a separator (e.g., separator 6). For example, a discharging system may be configured to receive or accept material at end 105 of deck 100 after the material has been processed or separated. The discharging system may include mechanisms or modules to divide material as it flows off of deck 100. For example, one or more of cutting fingers, vanes, baffles, and gates may be used to divide material as it flows off of deck 100. One or more hoppers or repositories may be included to accept the divided materials.

Any number of divisions and hoppers may be used. For example, separators with as few as two hoppers and as many as eight hoppers are frequently used in the field.

In some embodiments, the material at discharge end 105 may be divided into three fractions: heavy, middle, and light.

The heavy fraction may include material which is relatively heavy or dense and sank to the bottom of the bed during stratification. The heavy fraction may have been trapped by riffles (e.g., riffles 202) and moved uphill at an angle to the conveying action.

The light fraction may include material which is relatively light or of a low density that moved to the top of the bed during stratification. The light fraction may have floated over the heavier/denser material and moved downhill during the conveying action.

The middle fraction may include material that is too light to be in the heavy fraction and too heavy to be in the light fraction. The middle fraction may be the result of material that is variable in terms of density, particle size, or particle shape. In some embodiments, the middle fraction may be reclaimed by processing over a second machine/separator or by returning to the machine/separator. Often if shape or size is the cause of the middle fraction, the middle fraction may be processed over an alternate method of separation.

In some embodiments, the percentage of material (e.g., heavy material) in any fraction (e.g., a heavy fraction) may be a function of the nature of the material being separated and how well the material being separated may have been precleaned before processing via the separator. Materials which are of similar size and shape may be separated in accordance with density. Materials which are of similar density and shape may be separated in accordance with size. Materials which are of similar size and density may be separated in accordance with shape. When density, size, and shape all vary, the separation may be greatly influenced by the aerodynamic properties of the material and the weight of the material.

In some embodiments, collection of material (e.g., heavy, middle, and/or light fractions) may take place once the separated material is sufficiently concentrated.

The separators described above are illustrative. Modifications may be made to the separators. For example, decks may be of different sizes or made of various materials in some embodiments. Furthermore, one or more of the components, devices and systems described herein might not be included in a particular separator. Components, devices or systems not shown or described herein might be included in a particular separator.

In some embodiments, one or more computing devices may be included in, or associated with, a separator. The one or more computing devices may provide or serve as a control mechanism for the operation of the separator. The one or more computing devices may include, or be associated with, one or more transitory and/or non-transitory media comprising instructions that, when executed, cause the one or more computing devices (in connection with a separator) to perform the methodological acts and processes described herein. In some embodiments, the one or more computing devices may comprise one or more processors and memory storing instructions that, when executed by the one or more processors, cause the one or more computing devices to perform the methodological acts and processes described herein. In some embodiments, the one or more computing devices may allocate functionality amongst hardware, software, and firmware, or any combination thereof. The one or more computing devices may communicate with any number of devices or systems using any number or type of communication formats or protocols, over any type of communication medium. For example, the one or more computing devices may be part of a larger network and may communicate with any number of devices (optionally via one or more intermediary nodes or routers) via wired and/or wireless links.

Figure 5:
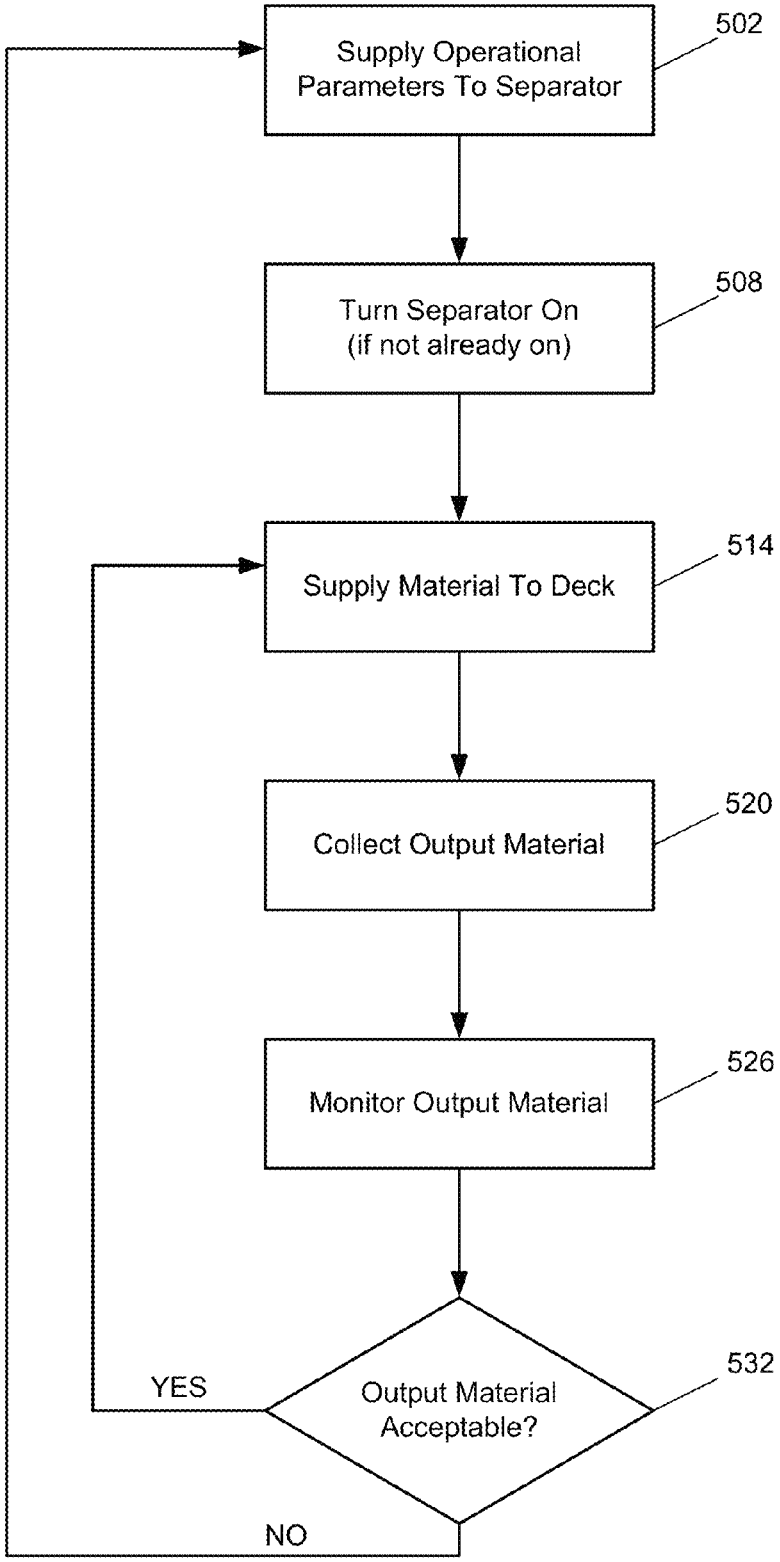
FIG. 5 illustrates a method suitable for demonstrating one or more aspects of this disclosure.

FIG. 5 illustrates a method that may be used to demonstrate one or more aspects of this disclosure. As shown in FIG. 5, in step 502 a set of operational parameters may be supplied to a separator (e.g., separator 6 of FIG. 1), and the separator may receive those parameters. As part of step 502, an operator or technician may make selections for the separator. The selections may include one or more values for a conveyance direction, tilt of the deck, an end-to-end slope of the deck, vibration speed or rate and stroke length, air flow (optionally including pressure, vacuum, and exhaust settings), discharge settings, riffle height, riffle spacing, and riffle angle relative to the conveyance direction. The selections may be made via one or more computing devices (e.g., a personal computer, a laptop, a server, a mobile device, etc.), optionally including one or more user interfaces. The one or more user interfaces may include one or more of a display screen, a keyboard, a button, a microphone, a speaker, a touchpad, a joystick, and the like. More generally, the selections may be received at a control module of a separator. The control module may be implemented using any combination of automated or manually-driven components or devices.

In step 508, the separator may be turned on (if it is not already on). The separator may be turned on automatically in response to a user locking-in or confirming the operational parameters in connection with step 502. Alternatively, or additionally, the separator may be turned on after a predetermined timeout (optionally measured from the operational parameters having been supplied in connection with step 502). In some embodiments, a user may have to perform a separate command or directive, such as pushing an 'on' or 'power' button associated with the separator, for the separator to turn on.

In step 514, material may be supplied to the deck of the separator. For example, in some embodiments the material may be supplied to the deck of the separator automatically by a feeder (e.g., feeder 120 of FIG. 1) in response to the separator being turned on in connection with step 508. In some embodiments, material might not be supplied to the deck until the separator has had an opportunity to "warm-up." For example, a delay may be imposed to ensure that the separator/deck is operating in accordance with the operational parameters supplied in connection with step 502. The delay may allow components, such as electrical or mechanical components, to reach a steady-state. As part of step 514, material that may be supplied to the deck may undergo separation as described herein.

In step 520, discharged output material (e.g., at discharge end 105 of deck 100) may be collected. The output material may be collected in one or more hoppers.

In step 526, the output material may be monitored. For example, the output material may be monitored for quality or consistency purposes. In some embodiments, the monitoring associated with step 526 may take place via automated control or monitoring systems. In some embodiments, the monitoring associated with step 526 may be based on a user, an operator, or a technician observing or manually testing the output material.

In step 532, a determination may be made whether the monitoring associated with step 526 indicates that the output material is acceptable within a given threshold. If the output material is acceptable ("yes" path taken out of step 532), then the process of supplying material to the deck (step 514), collecting the output material (step 520), and monitoring the output material (step 526) may continue. On the other hand, if the output material is outside of the threshold ("no" path taken out of step 532), then one or more of the operational parameters associated with step 502 may be modified or updated (optionally including shutting off or turning on one or more components, systems, or devices associated with the separator). The separator may be turned off as part of the flow from step 532 to step 502 along the "no" path out of step 532. As part of taking the "no" path from step 532 to step 502, collected material that is outside of the threshold may be fed back to the separator or provided to a separate process for reprocessing or handling.

The method of FIG. 5 may allow for initial crude or coarse settings to be supplied to the separator in connection with step 502, and those settings may be refined or updated (e.g., in connection with the "no" path out of step 532) to provide for a fine adjustment.

The method of FIG. 5 is illustrative. In some embodiments, one or more of the steps (or portions of the steps) shown in connection with FIG. 5 may be optional, and steps not shown may be included. Moreover, in some embodiments, the steps or portions thereof may be reordered or executed in a sequence different from what is shown in FIG. 5.

Aspects of the disclosure (e.g., aspects associated with methodological acts and processes described herein) may be tied to particular machines or apparatuses, such as a deck, a separator, a computing device, etc. Aspects of the disclosure may include transforming an article (e.g., unfiltered material) into a different state or thing (e.g., separated material suitable for collection and/or further processing, reclamation, handling, use, trade/exchange, etc.).

Aspects of the disclosure have been described in terms of illustrative embodiments thereof. While illustrative systems and methods as described herein embodying various aspects of the present disclosure are shown, it will be understood by those skilled in the art, that the disclosure is not limited to these embodiments. Modifications may be made by those skilled in the art, particularly in light of the foregoing teachings. For example, each of the features of the aforementioned illustrative examples may be utilized alone or in combination or subcombination with elements of the other examples. For example, any of the above described systems and methods or parts thereof may be combined with the other methods and systems or parts thereof described above in any order. It will also be appreciated and understood that modifications may be made without departing from the true spirit and scope of the present disclosure. The description is thus to be regarded as illustrative instead of restrictive on the present disclosure.

What is claimed is:

1. A method for operating a tilted deck of a separator, the tilted deck including riffles, the method comprising:
- applying a vibration to the tilted deck;
- providing material at a feed end of the tilted deck;
- collecting the material at a discharge end of the tilted deck;
- supplying a value for an operational parameter associated with the separator;
- determining that the material at the discharge end of the tilted deck is outside of a quality threshold; and
- modifying the value responsive to determining that the material at the discharge end of the tilted deck is outside of the quality threshold,
- wherein a conveyance direction parallel with a direction of the applied vibration and parallel with a flow direction of the material from the feed end to the discharge end, and
- wherein the vibration is imparted to the material by riffles, the riffles being aligned in parallel and at an acute angle relative to the conveyance direction.

2. The method of claim 1, wherein the tilted deck is adjustable with side-to-side tilt.

3. The method of claim 1, wherein the tilted deck is adjustable with feed end/discharge end tilt.

4. The method according to claim 1, further comprising:
- forcing air to pass through the tilted deck.

5. The method according to claim 1, wherein the riffles are arranged at different acute angles.

6. A method for operating a tilted deck of a separator, the tilted deck including riffles, the method comprising:
- supplying a value for an operational parameter associated with the separator;
- applying a vibration to the tilted deck;
- providing material at a feed end of the tilted deck;
- collecting the material at a discharge end of the tilted deck; and
- modifying the value responsive to a determination that the material at the discharge end of the tilted deck is outside of a quality threshold,
- wherein a conveyance direction parallel with a direction of the applied vibration and parallel with a flow direction of the material from the feed end to the discharge end, and
- wherein the vibration is imparted to the material by riffles, the riffles being aligned at an acute angle relative to the conveyance direction.

7. The method of claim 6, further comprising:
- determining that the material at the discharge end of the tilted deck is outside of the quality threshold.

* * * * *